US005303851A

United States Patent [19]

Libit et al.

[11] Patent Number: 5,303,851

[45] Date of Patent: Apr. 19, 1994

[54] SPRAY OR DISPENSING BOTTLE WITH INTEGRAL PUMP MOLDED THEREIN

[75] Inventors: Sidney M. Libit, Longboat Key, Fla.; Jeffrey M. Libit, 13244 Circulo Largo Ct., NE., Albuquerque, N. Mex. 87112

[73] Assignee: Jeffrey M. Libit, Albuquerque, N. Mex.

[21] Appl. No.: 974,561

[22] Filed: Nov. 12, 1992

[51] Int. Cl.[5] ..... B65D 37/00

[52] U.S. Cl. ..... 222/207; 222/211; 222/382; 222/385

[58] Field of Search ..... 222/207, 321, 382, 211, 222/383, 385; 239/333

[56] References Cited

U.S. PATENT DOCUMENTS

| | | | |
|---|---|---|---|
| 3,124,275 | 3/1964 | Lake | 222/207 X |
| 3,406,909 | 10/1968 | Pfeiffer | 222/321 X |
| 3,715,060 | 2/1973 | Benson | 222/207 |
| 3,995,774 | 12/1976 | Cooprider et al. | 222/207 |
| 4,863,071 | 9/1989 | Guss et al. | 222/382 X |

*Primary Examiner*—Gregory L. Huson

*Attorney, Agent, or Firm*—Laff, Whitesel, Conte & Saret

[57] ABSTRACT

A spray or dispensing bottle is preferably blow molded from plastic material which is squeezable, with a sufficient plastic memory to cause the plastic to return to its original shape after it is squeezed and relaxed. The bottle includes an integral tube which extends from the bottom of the bottle, upwardly to the top of the bottle. Along the route of this tube, an aneurism or bladder is formed to receive and hold fluid which is sucked up the tube when the bladder is squeezed. Check valves are provided for opening and closing the fluid path from the bottle to the bladder and out of a nozzle. Thus, the bladder may be repeatedly pressed to create a vacuum, causing it to fill, or if squeezed when full, to spray the fluid out of the bottle. In one embodiment, a lever arm is positioned over the bladder in order to increase the mechanical advantage and relieve the stress which results if fingers must be used to squeeze the bladder.

10 Claims, 2 Drawing Sheets

SPRAY OR DISPENSING BOTTLE WITH INTEGRAL PUMP MOLDED THEREIN

This invention relates to plastic spray pump and dispensing pump bottles and more particularly to low cost throw away bottles with built in pumps molded herein.

A window cleaner spray bottle is an example of the class of spray bottles which the invention addresses. Hard surface sprayers, hair and cosmetic spray applications, and pesticide sprayers are additional examples of applications which the invention addresses. U.S. Pat. No. 4,600,130 shows one example of a prior art squeeze bottle with an integral siphon tube.

There are many other spray bottles with a relatively low cost product packaged therein. Sometimes the spray mechanism of these other bottles costs more than the product within the bottle. Therefore, sometimes the initial sale includes a filled spray bottle and subsequent sales are refills for the spray bottle, rather than new spray bottles. This saves the consumer money. Nevertheless, for some consumers, the refilling of the bottle is a chore which discourages further sales. Therefore, the customer often chooses to throw away the initial bottle with the spray mechanism, and then purchase another filled bottle with another spray mechanism, thereby re-investing in multiple spray mechanisms.

There are many other problems with the spray bottles of the described type. They are often relatively complicated, so that many small parts must be handled and assembled during manufacture. For example, many spray mechanisms include piston-style pumps, trigger handles, siphon tubes, and nozzles of variable spray configurations. Also, since every part represents some probability, however slight, of failure during operation, there are almost certainly a higher than necessary number of faulty bottles.

Yet another problem is that the spray mechanism generally adds a substantial height to the bottle, which sometimes makes it too tall for storage on a shelf. As a generality, customers do not like tall products. If they have a choice between equivalent products of different height, they will pick the shorter, more compact product. Also, the cost of packaging products increases with size; therefore, a reduction in the height of a product usually saves considerably in the cost of packing, handling, and shipping. In at least one case, the savings in packaging space may be as much as approximately 15%, after the space demands of the pump is reduced by the invention.

Still another consideration relates to a need for pumps that may be used with very small sized bottles, such as trial sizes or free samples. A traditional pump for these very small bottles is sometimes larger than the bottle. It would be most difficult to hold such a small bottle while operating such a large conventional pump. Also, the pump could cost much more than the product in these small sizes, thus making it economically impossible to use free samples or trial sizes as a sales tool.

Accordingly, an object of the invention is to provide new and improved spray bottles. In this connection, an object is to provide very low cost spray bottles which may be smaller in size and which function more reliably. Here, an object is to provide a spray bottle with a pump which may be formed at almost no additional cost when a plastic bottle is molded. Another object is to provide a totally recyclable bottle, which may be made entirely of recyclable plastic.

In keeping with an aspect of the invention, these and other objects are provided by a preferably blow molded bottle made of a plastic material which is squeezable, with a sufficient plastic memory to cause the plastic to return to its original shape after it is squeezed and relaxed. The bottle includes an integral tube which extends from the bottom of the bottle, upwardly to the top of the bottle. Along the route of this tube, an aneurism or bladder is formed to retrieve and hold fluid which is sucked up the tube when the bladder is squeezed. Check valves are provided for opening and closing the path from the bottle to the bladder and out a nozzle. Thus, the bladder may be repeatedly pressed to create a vacuum, causing the bladder to fill with liquid drawn through the integral tube. Thereafter, when the bladder is squeezed, the liquid sprays out of the bottle.

Preferred embodiments of the invention are shown in the attached drawings, in which:

FIG. 1 shows a preferable blow molded bottle 20, although it may be made by any suitable process. Preferably the bottle is made of a plastic which is fairly easy to squeeze, but with a plastic memory sufficient to cause the bottle to return to its original shape when it is released after it has been squeezed.

The bottle has a principal liquid or fluid containing chamber 22 which may be filled via a conventional neck opening 24. The bottle has a tube 26 integrally formed therewith as the bottle is blow molded. At 27, the bottom of the tube 26 is in open communication with the interior of the chamber 22. Therefore, as the level of the liquid or fluid rises with the filling of the chamber 22, that same liquid or fluid also rises in the tube 26.

Figure 1:
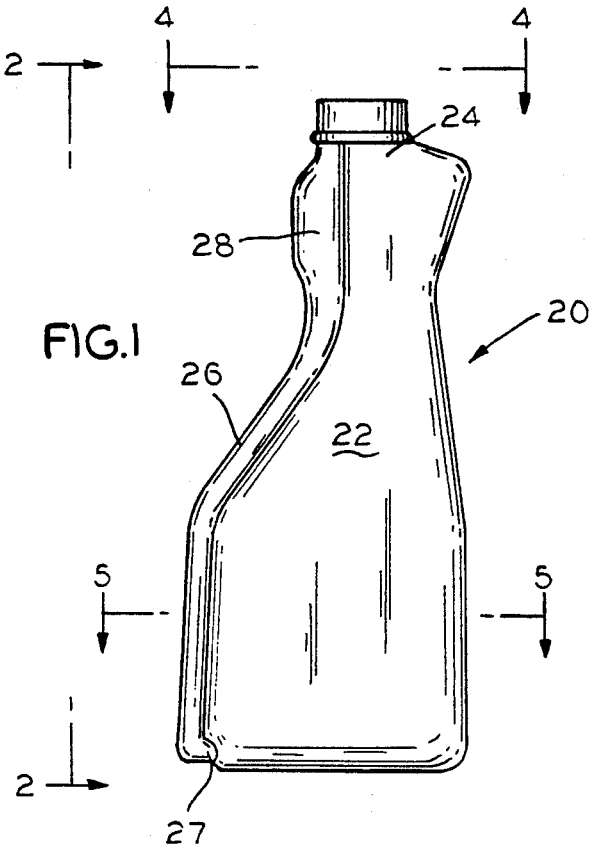
FIG. 1 is a side elevation of a preferred embodiment of the invention.
Figure 2:
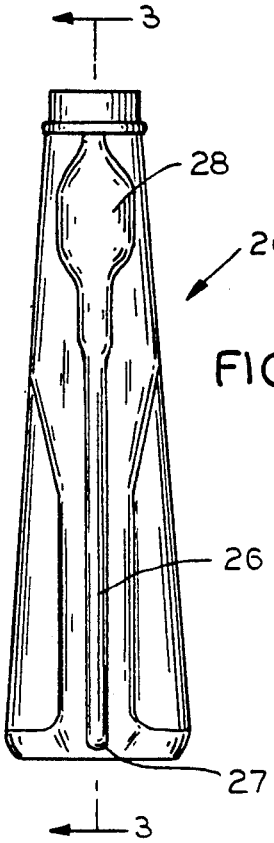
FIG. 2 is an edge elevation taken along line 2—2 of FIG. 1.
Figure 3:
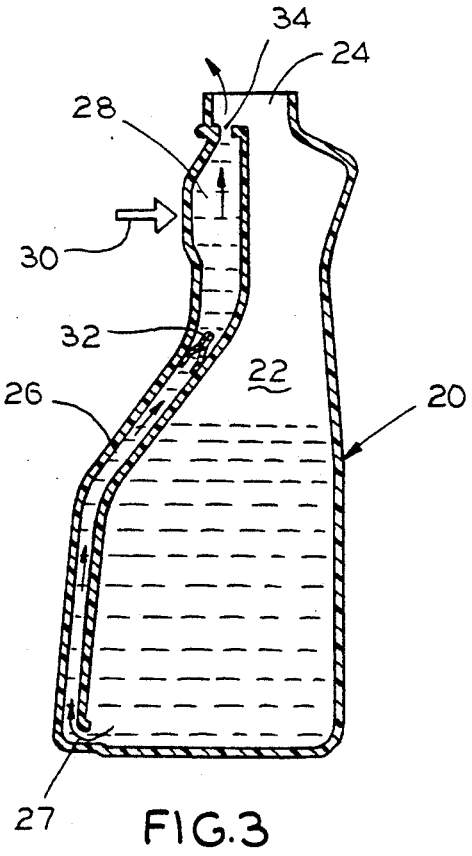
FIG. 3 is a cross section of the bottle of FIG. 1.
Figure 4:
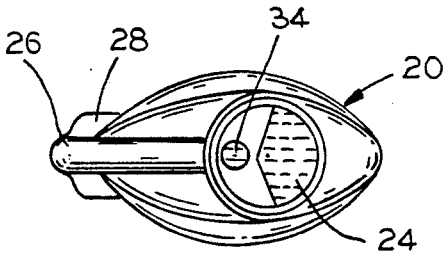
FIG. 4 is a top plan view taken along line 4—4 of FIG. 1.
Figure 5:
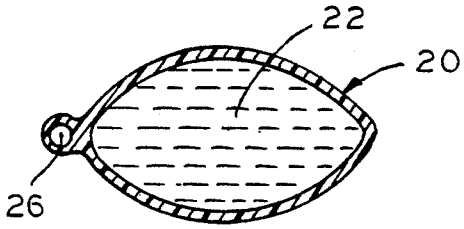
FIG. 5 is a cross section taken along line 5—5 of FIG. 1.
Figure 6:
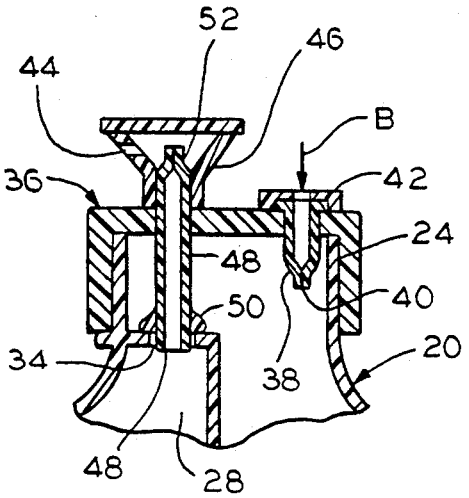
FIG. 6 is a cross section of a cap for the bottle.

The tube 26 includes at least one enlarged aneurism or bladder formed at 28. This bladder is reduced in volume or compressed when squeezed by a finger or hand, as indicated by arrow 30 (FIG. 3). When the finger or hand relaxes, the memory of the plastic causes the bladder 28 to return to its prior and normal shape. The upper end of tube 26 terminates in an opening 34. A suitable check valve 32 (FIG. 3) is inserted through the top opening 34 (FIGS. 3, 4) of the tube 26 and pressed to an anchor point between chamber 22 and the bladder 28. The check valve 32 may be anchored in various ways. For example, the check valve 32 may be heat sealed, ultrasonically welded, cemented or snapped into place within the tube 26. This check valve 32 may be any suitable devise, such as either a ball valve or a duck bill valve. A duck bill valve is a rubber tube with a slit at the top so that a fluid entering the bottom of the tube may be forced out the slit, but a fluid above the tube cannot be forced down through the slit and back into the tube. The important feature here is that fluid is restricted so as to flow in only one direction through the valve.

The cap 36 for the bottle 20 includes a second check valve 38. Here again, the check valve may be any suitable device, such as a ball valve or a duck bill valve. In particular, the valve 38 is here shown as a duck bill valve where a fluid (air) may pass in direction B through a slit 40, but may not pass in a reverse direction from inside the bottle through slit 40 to the outside air. A suitable plastic cap 42 may be screwed on, press-fitted, cemented or welded onto the bottle cap 36 in order to secure the duck bill (or other) check valve 38 in place.

On top of the cap 36, there is a suitable nozzle 44 through which the fluid escapes as it is sprayed from the bottle. This nozzle 44 may have any geometry which is most convenient for the intended use. Here, the nozzle is shown in a pedestal 46 projecting above the cap 36; however, it could as well be a pinhole in the cap 36 itself or a tube molded into the cap.

A tube 48 is suitably anchored in and dependent below pedestal 46. A check valve (here a duck bill valve) 52 is in a location which forces fluids to follow a one way path through tube 48 and out nozzle 44. A sealing mass of a relatively soft elastomer or rubber-like material 50, such as silicone, surrounds the dependent tube 48.

When the cap 36 is placed on the neck of the bottle 20, the tube 48 fits into the bladder 28 via the opening 34. The soft rubber 50 fits around and seals any space between tube 48 and the perimeter of hole 34. In or near tube 48, a third check valve 52 enables fluid to move out nozzle 44, but not back into the nozzle 44. Air is precluded from entering the bottle through nozzle 44 by third check valve 52.

The cap 36 may be secured to the neck 24 of bottle 20 in any suitable manner. For example, cap 36 may be heat sealed or ultrasonically welded to the bottle 20. Of course, any other suitable arrangement may be provided for securing the cap 36 in place.

It should now be apparent that the check valves provide a one way path from the external atmospheric air, through check valve 38 in direction B, to the interior chamber 22, through opening 28, up tube 26, through check valve 32, bladder 28 and out opening 34 to tube 48, through check valve 52 and out the nozzle 44.

In operation, one finger, multiple fingers, or a hand applies a pressure 30 against bladder 28 and forces any air in the bladder through check valve 52 and out nozzle 44. The bladder 28 reduces its volume under the pressure 30. When the pressure 30 is relaxed, the memory of the plastic causes the bladder 28 to return to its original shape, thus creating a vacuum inside the bladder since air cannot return from the atmosphere through check valve 52. The vacuum in bladder 28 sucks fluid from chamber 22 and up the tube 26 into the bladder 28.

The next time that a pressure 30 is applied to the now full bladder 28, check valve 32 prevents a back flow of fluid from the bladder 28 to the principal bottle chamber 22. Rather, the fluid is forced from bladder 28 through the check valve 52 and out the nozzle 44. As the fluid leaves the bottle atmospheric air may flow through check valve 38 and into the bottle in order to replace the fluid displaced as it is sprayed from the bottle.

Figure 7:
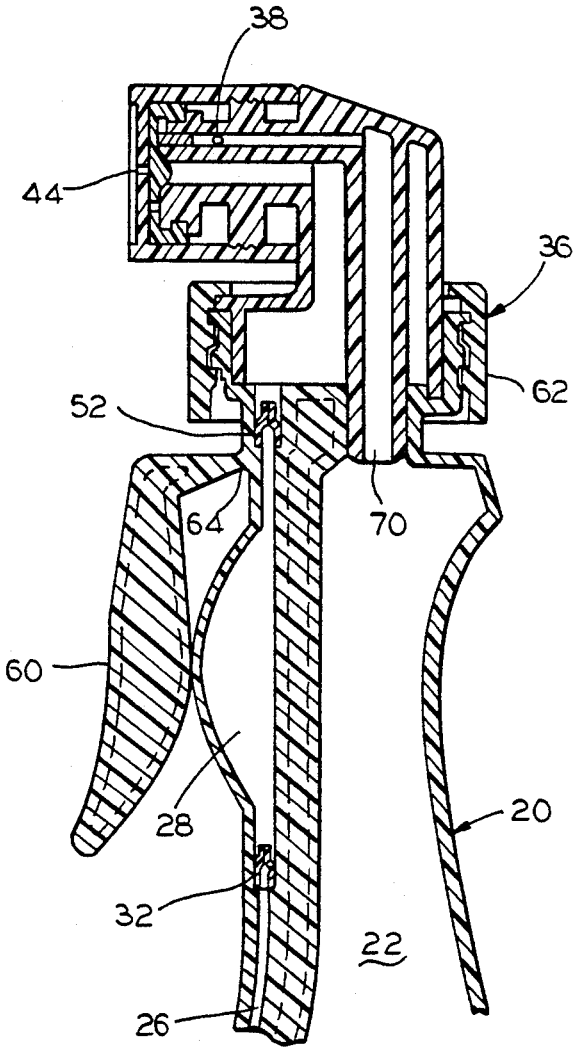
FIG. 7 is a cross section of an alternative embodiment giving leverage to squeeze a bladder.

FIG. 7 shows an alternative embodiment where a lever arm 60 is included with the bottle. The lever arm 60 may be hung on the bottle neck or molded as part of the cap. If desired, the lever arm may be integrally molded to the bottle. In the embodiment of FIG. 7, the lever arm is attached to the neck of the bottle by a living hinge 64 and contacts bladder 28 in a very small area which is sufficient to stabilize the neutral positions of the lever 60 and bladder 28. Thus, when the lever 60 is squeezed toward the bottle, the entire hand may be used. The bladder collapses, with the results described above in connection with pressure 30. The reference numerals in FIG. 7 designate corresponding parts in FIGS. 1–6. This embodiment with a lever provides mechanical advantage, since it enables a person to use an entire hand to squeeze the bladder 28. This, in turn, enables a person with less physical strength, or with a large job requiring repetitive squeezing, to easily use the spray bottle.

In this particular example, a separate threaded ring 62 enables the cap to be tightened into place without turning the part of the cap that includes the check valve 52 and the connection 70 to the fluid chamber 22.

Those who are skilled in the art will readily perceive how to modify the invention. Therefore, the appended claims are to be construed to cover all equivalent structures which fall within the true scope and spirit of the invention.

The invention claimed is:

1. A liquid dispensing or spraying, multi-chambered bottle, comprising an opening in said bottle for receiving liquids, said liquid initially entering a first chamber of said bottle, and a second chamber integrally formed and in communication with said first chamber for receiving liquid from said first chamber, said second chamber comprising a tube extending outside of said first chamber from an opening at a bottom of said first chamber to said liquid receiving opening, said tube having an area of enlarged volume forming a bladder area for squeezing in a direction transverse to a longitudinal dimension of said tube, at least said enlarged bladder area having a memory for causing it to return to its normal position when it is released after having been squeezed;

a first valve between said enlarged bladder and said first chamber for enabling liquid to flow from said first chamber to said enlarged bladder, but not in the reverse direction;

a cap covering said bottle opening, said cap having an opening with means for enabling air to enter but not to leave said first chamber; and a second valve between said cap and said second chamber, said second valve enabling liquid to flow from said second chamber and out of said cap, said second valve preventing air from entering said second chamber.

2. The liquid dispenser of claim 1 wherein each of said valves is a duck bill valve.

3. The liquid dispense of claim 1 wherein said first valve is located in said tube at a position between said enlarged bladder and said first chamber.

4. The liquid dispenser of claim 3 wherein said first and second chambers are blow molded.

5. The liquid dispenser of claim 4 wherein said cap has a dependent tube with soft and spongy elastomer surrounding it, said dependent tube fitting into said bladder when said cap is in place, whereby said elastomer seals said dependent tube to said bladder.

6. A plastic spray or dispensing bottle of the type having a neck, sides, and a bottom, said bottle further comprising a chamber which is filled via an opening in said neck on said bottle, a cap having a nozzle therein closing said bottle, a tube integrally formed with said chamber and running from near the bottom of said bottle up a side of said bottle to approximately the top of said bottle, the bottom end of said tube being open for fluid communication from said bottle, the top end of said tube being open for fluid communication to said nozzle in said cap, said tube having at least one area of enlarged volume adjacent to said neck on said bottle and at a location which is convenient for a user to squeeze, said plastic being flexible enough to be squeezed to a reduced volume, said plastic having a memory which returns said area to said enlarged volume when said user releases said squeeze, and check valve means for enabling only a one way fluid flow from said bottle through said tube to said nozzle.

7. The bottle of claim 6 wherein said check valve means comprises at least two check valves, a first of said check valves located in said tube and between said bottle and said area of said enlargement, and a second of said check valves located in said tube between said cap and said area of enlargement.

8. The bottle of claim 7 and a tube dependent from said cap for providing fluid communication between said area of enlargement and said nozzle, a soft elastomer surrounding said dependent tube for sealing said passageway between said nozzle and said area of enlargement.

9. The bottle of claim 7 wherein said check valves are duck bill valves.

10. The bottle of any one of the claims 3–8 and lever means associated with said area of enlargement for squeezing said area of enlargement in order to reduce the volume thereof, one end of said lever being joined to said bottle by a living hinge and the other end of said lever contacting said area of enlargement in an area sufficiently large to stabilize the position of said lever.

* * * * *